US010260272B1

(12) United States Patent
Ivester

(10) Patent No.: US 10,260,272 B1
(45) Date of Patent: Apr. 16, 2019

(54) INDOOR SAFETY SHELTER FOR PROTECTION FROM INTRUDERS

(71) Applicant: David Ivester, Henrico, VA (US)

(72) Inventor: David Ivester, Henrico, VA (US)

( * ) Notice: Subject to any disclaimer, the term of this patent is extended or adjusted under 35 U.S.C. 154(b) by 0 days.

(21) Appl. No.: 15/909,027

(22) Filed: Mar. 1, 2018

Related U.S. Application Data

(60) Provisional application No. 62/636,143, filed on Feb. 27, 2018, provisional application No. 62/465,585, filed on Mar. 1, 2017.

(51) Int. Cl.

| | |
|---|---|
| ***E05G 1/02*** | (2006.01) |
| ***E05G 1/00*** | (2006.01) |
| ***E05G 1/024*** | (2006.01) |
| ***E05G 1/026*** | (2006.01) |

(52) U.S. Cl.
CPC ..... *E05G 1/024* (2013.01); *E05G 1/005* (2013.01); *E05G 1/026* (2013.01)

(58) Field of Classification Search
CPC ..... E05G 1/024; E05G 1/005; E05G 1/026
See application file for complete search history.

(56) References Cited

U.S. PATENT DOCUMENTS 2,317,392 A * 4/1943 Lord ..... F41H 5/24 52/276
2,713,262 A * 7/1955 Webster ..... G01M 99/00 73/167
2,842,222 A * 7/1958 Hughett ..... G01M 9/04 181/203
3,456,405 A * 7/1969 Naoto ..... E04H 5/10 52/199
4,934,245 A * 6/1990 Musante ..... F41H 5/04 428/328
8,955,262 B2 2/2015 Thompson
9,021,612 B1 5/2015 O'Neal
2001/0039770 A1 11/2001 Arnold
2003/0037812 A1* 2/2003 Stewart ..... A47K 3/286 135/96
2012/0159881 A1* 6/2012 White ..... E06B 5/106 52/208
2012/0234164 A1* 9/2012 Kucherov ..... F41H 5/0407 89/36.02
2014/0310938 A1* 10/2014 Parida ..... F41H 5/04 29/428

(Continued)

FOREIGN PATENT DOCUMENTS

DE 3730371 A1 * 3/1990 ..... F41H 7/044
JP 2007327232 A * 12/2007
JP 4663091 B2 * 3/2011

*Primary Examiner* — Jeanette E Chapman
(74) *Attorney, Agent, or Firm* — Beth L. Smiley, Esq.

(57) ABSTRACT

An indoor safety shelter appearing to be one file cabinet or a sset of file cabinets is disclosed constructed with bullet-proof armor plates mounted on an interior support frame which protects one or more persons inside the shelter both from being discovered by and being harmed by an armed intruder in the case of a home or office invasion. The shelter can be assembled and disassembled on site from the interior of the structure providing for the ability of one or more persons protected inside the shelter to detach the plates if the bullet-proof door to the shelter, which is locked from the inside, becomes obstructed. The interior frame of the shelter has castors which allow the shelter to be moved.

20 Claims, 15 Drawing Sheets

(56) References Cited

U.S. PATENT DOCUMENTS

| | | | | |
|---|---|---|---|---|
| 2015/0096478 | A1 | 4/2015 | Magiera | |
| 2015/0096479 | A1 | 4/2015 | McCarthy | |
| 2015/0343900 | A1* | 12/2015 | Schlangen | B60G 3/20 180/247 |
| 2016/0130830 | A1 | 5/2016 | Magiera | |
| 2016/0185207 | A1* | 6/2016 | Gerschutz | B60K 6/52 180/243 |
| 2016/0245622 | A1* | 8/2016 | Pfister | F41H 7/048 |

* cited by examiner

INDOOR SAFETY SHELTER FOR PROTECTION FROM INTRUDERS

CROSS-REFERENCE TO RELATED APPLICATIONS

This application claims the benefit of U.S. Provisional applications No. 62/465,585 filed Mar. 1, 2017 and No. 62/636,143 filed Feb. 27, 2018, the contents of which are hereby incorporated by reference in their entirety.

STATEMENT REGARDING PRIOR DISCLOSURES BY THE INVENTOR OR A JOINT INVENTOR

Disclosures have been made only to draftsmen who produced formal application or production drawings and to potential manufacturers of the invention for the inventor, said disclosures being covemd by appropriate nondisclosure agreements between the parties.

BACKGROUND

1. Technical Field

The invention relates to indoor safety shelters. More specifically, the invention relates to a bullet-proof shelter disguised as a file cabinet or set of file cabinets to protect one or more people during an invasion or attack in the office or home.

2. Background Information

There are many parts of the world that can be more dangerous for certain citizens whether due to career choice, success or personal relations. Conventional safe rooms are typically a permanent room located within the occupant's home or business. These permanent, inunobile rooms typically provide a barrier from kidnapping and physical damage from intruders. These conventional safe rooms are not mobile and are relatively expensive. Moving from'one residence or office to another requires expensive demolition of the existing safe room and additional, expensive, new construction for a new safe room in the new location. In some instances demolition and new or additional construction are not feasible leaving an occupant vulnerable while at other locations. Additionally, typically there is one safe room per building, requiring the occupant to navigate to that location during the event, of a hostile attack. A permanent safe room only provides protection in that building, in that room and not when the occupant is elsewhere in their home, office or other buildings where they may spend a good deal of time.

Conventional safe rooms and shelters protect persons and property from dangerous storms and conditions, such as hurricanes and tornadoes, as well as the accompanying flying debris. Strong storms and flying debris can result in significant injury and damage to person and property. These previous inventions are made for outdoor or indoor use, usually for below ground protection.

Outdoor safe rooms are typically buried underground and are permanent structures or fixtures to the property. However, neither outdoor nor indoor storm protection rooms are specifically intended for or designed for protection against armed intruders. For protection against intruders, prior art includes an expensive, indoor, dedicated safe room as a permanent addition to real property.

Indoor safe rooms are typically a hidden, dedicated room within the office or home. These rooms are typically not mobile and occupy a large amount of square footage of usable living space compared to the current invention.

Because these rooms are not mobile, a new safe room must be built with each business or home address change and adapted to the occupants' needs and specifications at the new location. The cost of rebuilding, is burdensome and in some cases prohibitive.

One such device is a mobile, indoor or outdoor safe room. However, that invention is designed for protection from storms and suffers from some shortcomings. One such problem is the lack of strength of the barrier material used to protect the occupant from intruders. While this type of structure does protect, to some degree, from physical injury from flying objects, it is not completely impermeable. Such an invention was not designed Mr or capable of providing protection from armed intruders.

BRIEF SUMMARY OF THE INVENTION

The invention herein disclosed is a modular bullet-proof indoor safety shelter constructed in the shape of a file cabinet or set of two or more file cabinets such that the shelter appears to be ordinary office furniture. The safety shelter resembles ordinary office furniture so that, in the event of a home or office invasion where the shelter is located, a person or persons may hide inside the shelter and may avoid being discovered therein by a potential attacker while having the ability to contact outside help via phone or internet access. Various decorative elements may be added to different embodiments of the shelter invention to, further enhance this disguise function of the shelter.

In the event of a home or office invasion in which an attacker discovers that one or more people are hiding within the shelter disclosed herein, the shelter, which comprises one or a combination of bullet proof armor plate materials providing a greater level of protection from ballistic attack than other safety shelters in the prior art, protects the occupants of the shelter embodied by the invention herein disclosed while allowing the occupants to contact help via phone or internet access within the shelter. The armor plates of the shelter are preferably comprised of ar500 grade armor plates having a thickness of ¼ inch or ½ inch.

To meet the requirements of various customers, more than one;layer of ar500 grade armor, plates;or such plates having a different thickness up to and including 1 inch may he used to construct the shelter. Armor plates comprised of other materials may also be used in combination with or instead of ar500 grade, armor plates, The relative ease with which the heavy ar500 grade plates or other plates may be affixed to of removed from the internal frame has advantages such as allowing parts of the shelter to be shipped and moved separately and permitting modification of a shelter according to the invention disclosed herein already as; in a customer's home or office.

Armor plates of the invention comprising at least three sides and the top of the safety shelter are reversibly mounted on an interior frame preferably comprised of carbon steel members welded together, the frame defining a rectangular base, four sides, a top and an open interior, with at least one of the sides defining a door frame. Armor plates are installed inside the base of the frame forming a floor. The base of the frame is preferably supported by at least four castors affixed to the frame. Armor plates define the top and at least three sides of the shelter and are affixed external to the interior frame such that a person inside the shelter can detach one or more of the armor plates from the shelter while in the shelter and push the plate or plates away from the frame thereby providing an alternative means for a person to escape from the safety shelter if a door mounted to a side of the frame cannot be opened or becomes blocked.

A door, also comprised of one or MOM armor plates, covers the side or part of a side of the frame defining a door frame and is mounted to the frame by at least two hinges. A sliding latch affixed by one or more brackets to the interior side of the door can be used to latch the door, when the door is in a closed position, by a person in the interior of the shelter and is, not accessible or visible to a person outside the shelter. The door may define a peephole therethrough such that a person hiding in the shelter can see outside the shelter and can engage an attacker with a firearm such as a handgun. The peephole may be covered by a shield comprised of armor plate when not in use, the shield being affixed to the interior side of the, door by a bracket or brackets.

BRIEF DESCRIPTION OF THE DRAWINGS

The appended claims are intended to point out with particularity and claim distinctly the subject matter of this invention. The various objects, advantages and novel features of this invention will be more fully apparent from a reading of the following detailed description in conjunction with the accompanying drawings in which like reference numerals refer to like parts, and in which:

DESCRIPTION OF ILLUSTRATIVE EMBODIMENTS

Figure 1:
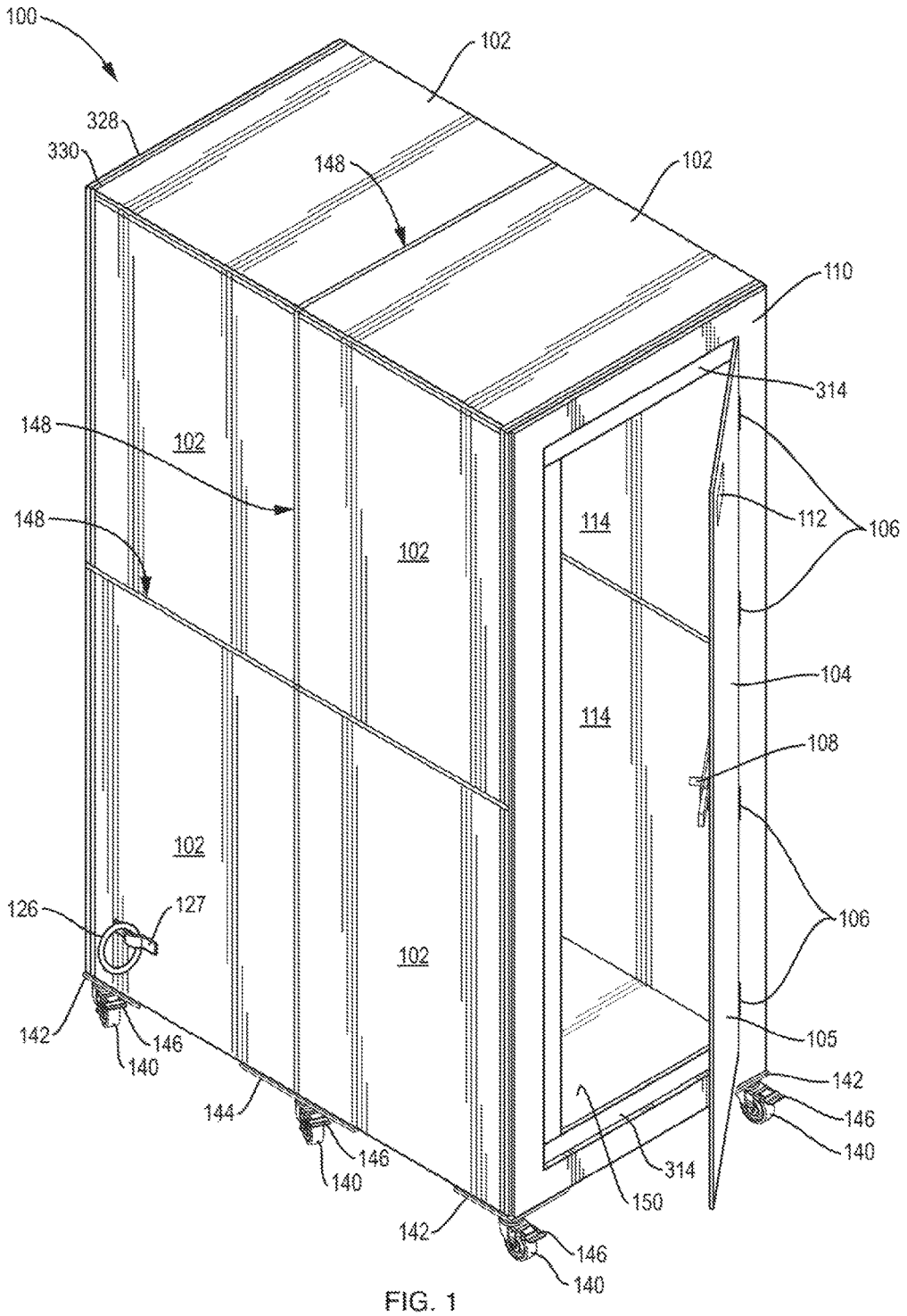
FIG. 1 is a perspective view of a single modular unit of the safety shelter in the shape of a file cabinet according to an embodiment of the present invention.

FIG. 1 illustrates a perspective view of a single module unit 100 of one embodiment of the customized, modifiable, bullet-proof, moveable, free-standing, indoor safety shelter, in the shape of a file cabinet, for shielding a person or persons inside the shelter both from being detected by an intruder and from being harmed by gunshot or other attack during a home or office invasion as assembled for use. Armor plates 102 are shown comprising the exterior surface of the shelter 100. The words shelter and cabinet are used interchangeably in this disclosure. In the embodiment shown the armor plates 102, 114 and 150 are comprised preferably of ¼ or ½ thick ar500 grade armor plates chosen for their ability to protect a person inside the shelter from attack by more powerful ballistic weaponry compared to the prior art. The door 104 of the shelter 100 is comprised of ono or more plates of armor, preferably ¼ or ½ thick ar500 grade armor plate, affixed to the shelter 100 by hinges 106 such that when the door 104 is in a closed position the exterior surface of the door 105 is flush with the front face 110 of the shelter 100. The door 104 opens only in an outward direction and is prevented from opening inward by contact with the doorframe. The hinges 106 are affixed to the interior of the door 312 and interior frame 200 (FIG. 2) so as not to be visible from the exterior of the shelter 100 to the extent possible when the door 104 is in a closed position. When in a closed position, the door 104 appears to be much like the other sides of the shelter absent decorative elements.

Figure 6A:
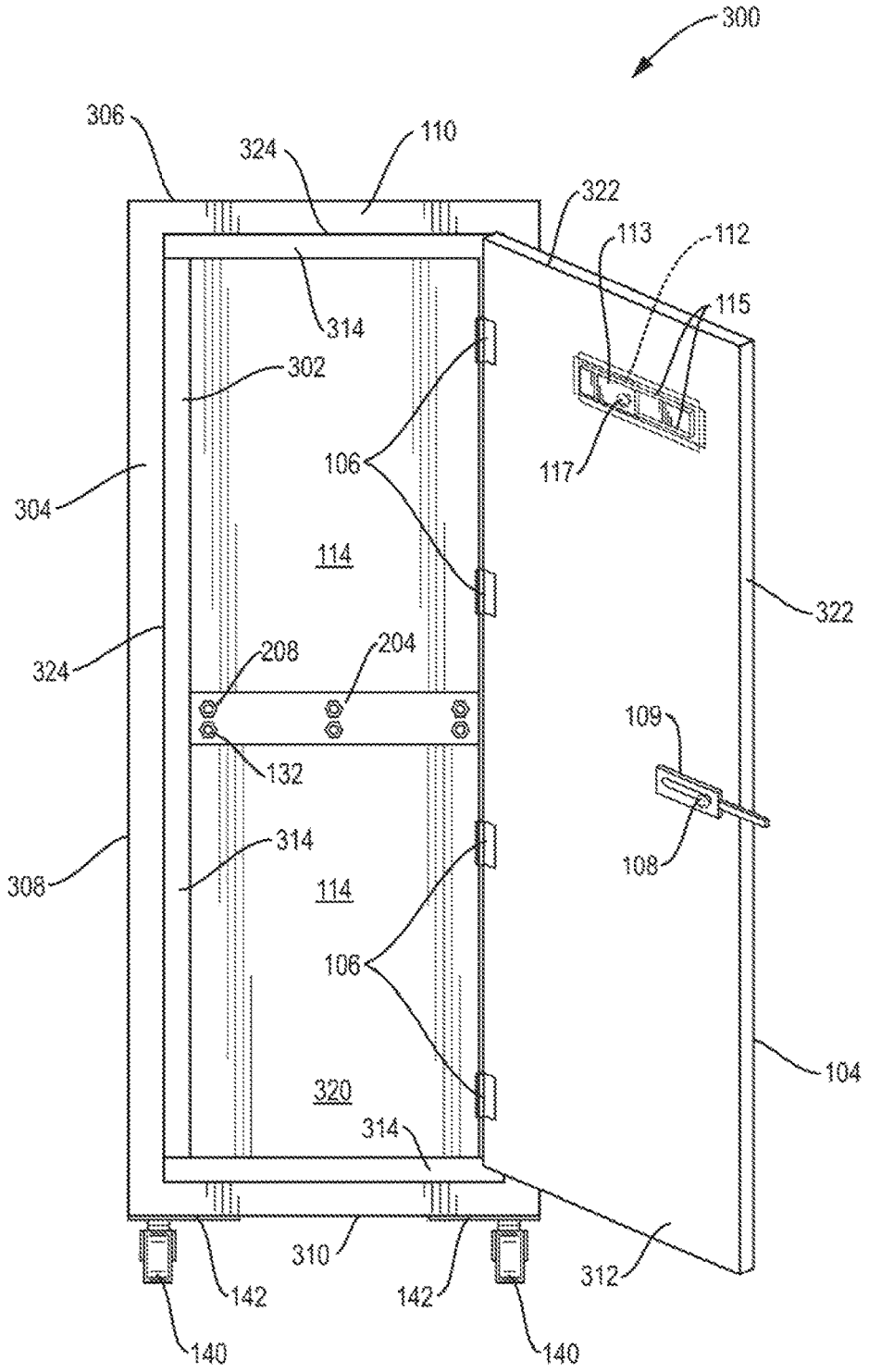
FIG. 6A illustrates a front view of an assembled embodiment of the present invention shown in FIGS. 1-5 with the door open and showing a sliding latch and peephole shield affixed to the interior of the door.
Figure 6B:
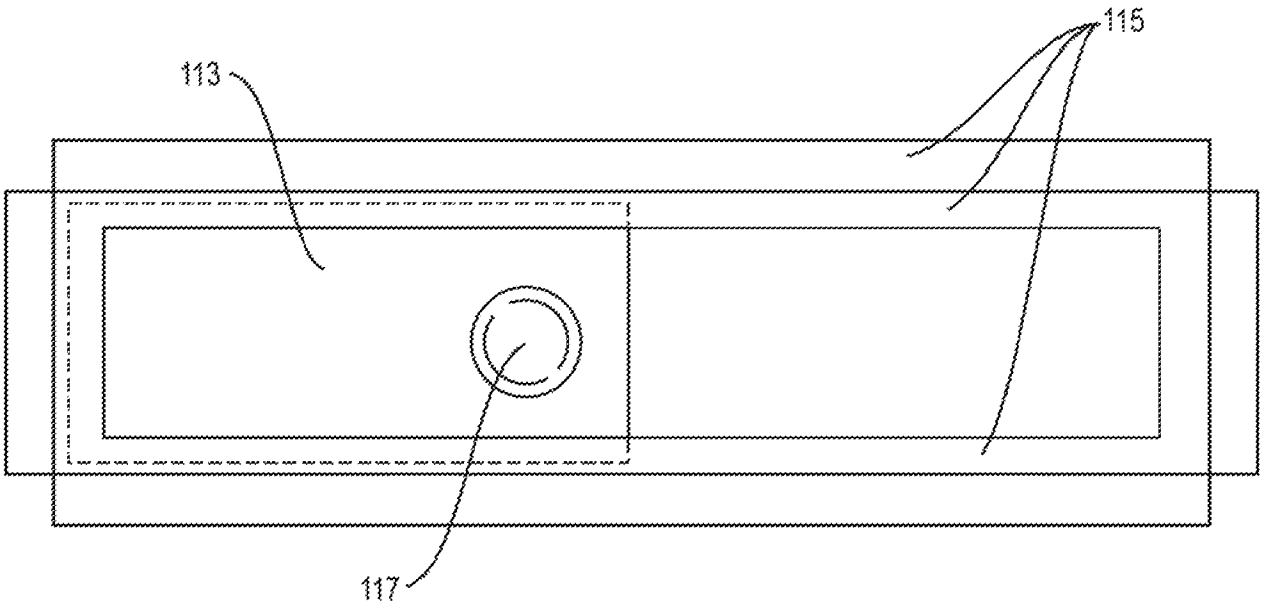
FIG. 6B is an expanded view of the peephole shield affixed to the door interior as shown in FIG. 6A according to an aspect of the present invention.

The door 104 has at least one sliding latch 108 within a carbon, steel bracket 109 affixed to the interior 312 of the door 104 that can only be operated by a person in the interior 320 of the shelter 100 to secure the door 104 in a closed position. Other embodiments of this invention may include other types of latches to secure the door 104. The door 104 shown in FIG. 1 defines a peephole 112 that can be opened by a person inside 320 the shelter 100 to see outside the shelter 100 when the door 104 is in a closed position. The peephole 112 also allows an occupant of the shelter 100 to engage an attacker with a firearm, for example, or with mace or bear repellant projected through the peephole 112 at a target outside the shelter 100. The peephole 112 is covered by a shield 113, preferably comprised of ½ thick ar500 grade armor plate, when the peephole 112 is not in use as shown in FIGS. 6A and 6B. Also shown in FIG. 1 is a security ring 126 which is welded to the exterior side 250 of one of the armor plates 102 by a bracket 127. A chain or theft-proof cable may be attached to the security ring 126 so as to prevent the movement of the shelter 100 out of the room or area in which it is positioned. The security ring 126 is, preferably attached to the shelter in a position so as not to be visible to a potential attacker.

Figure 2:
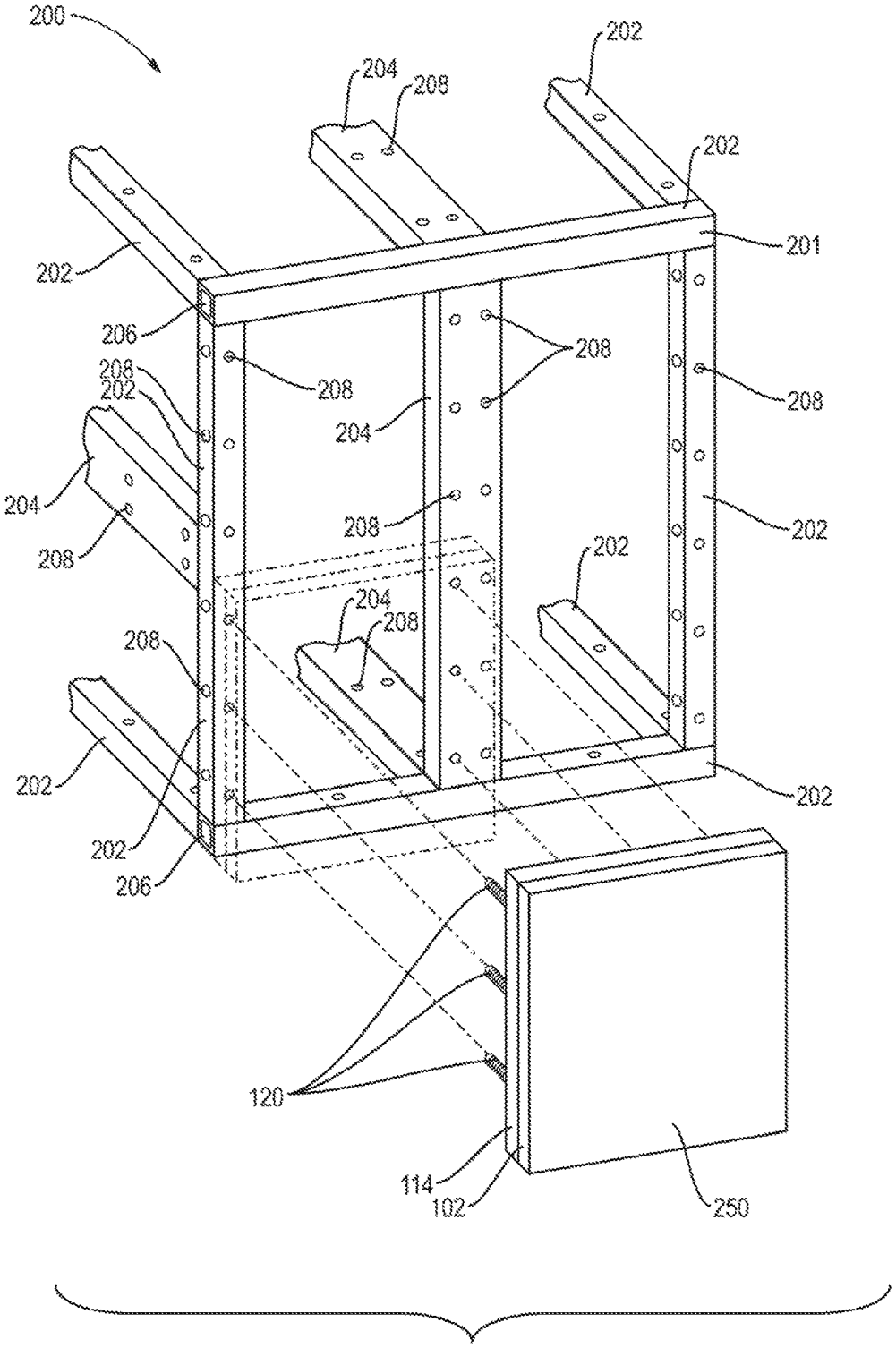
FIG. 2 is a side perspective view of the frame internal to the embodiment of the invention shown in FIG. 1. Also shown is the method for attachment of a set of external armor plates so as to mount them to the frame.

FIG. 2 shows a perspective view of one side 201 of an internal frame 200 in part as assembled. In this embodiment the inner frame 200 is comprised of carbon steel segments 202 and 204 defining hollow passages 206 therethrough. In other embodiments of the invention the segments 202 and 204 may be comprised of aluminum. Segments 202 have a square cross section and segments 204 have a rectangular cross section, the wider rectangular segments providing for sets of armor plates 114 and 102 to be assembled side by side on the frame 300. The steel sements 203 and 204 may have a slit (not shown) along the length of the segments formed in the manufacturing process. The segments 202 and 204 are welded together by methods known in the art to form the assembled inner frame 200 as shown. In other embodiments of the invention the segments 202 and 304 may be bolted together to form the frame 200 and in still other embodiments the internal frame 200 may be reinforced by methods known in the art according to the needs of the customer, the thickness, type of material and number of armor plates 102 and 114 comprising the shelter which must be supported by the frame 200, In still other embodiments of the invention the segments 202 or 204, comprised of either carbon steel or aluminum, may be connected to other such segments using pre-made couplers (not shown) known in the art that insert into the hollow ends 206 of the segments 202 and/or 204. As a unit the frame 200 defines a rectangular base, four sides, a top and an open interior 320, one of said sides defining a door frame. In some embodiments of the invention the interior 320 of the shelter may include structural support members affixed to the interior frame 200.

Figure 3:
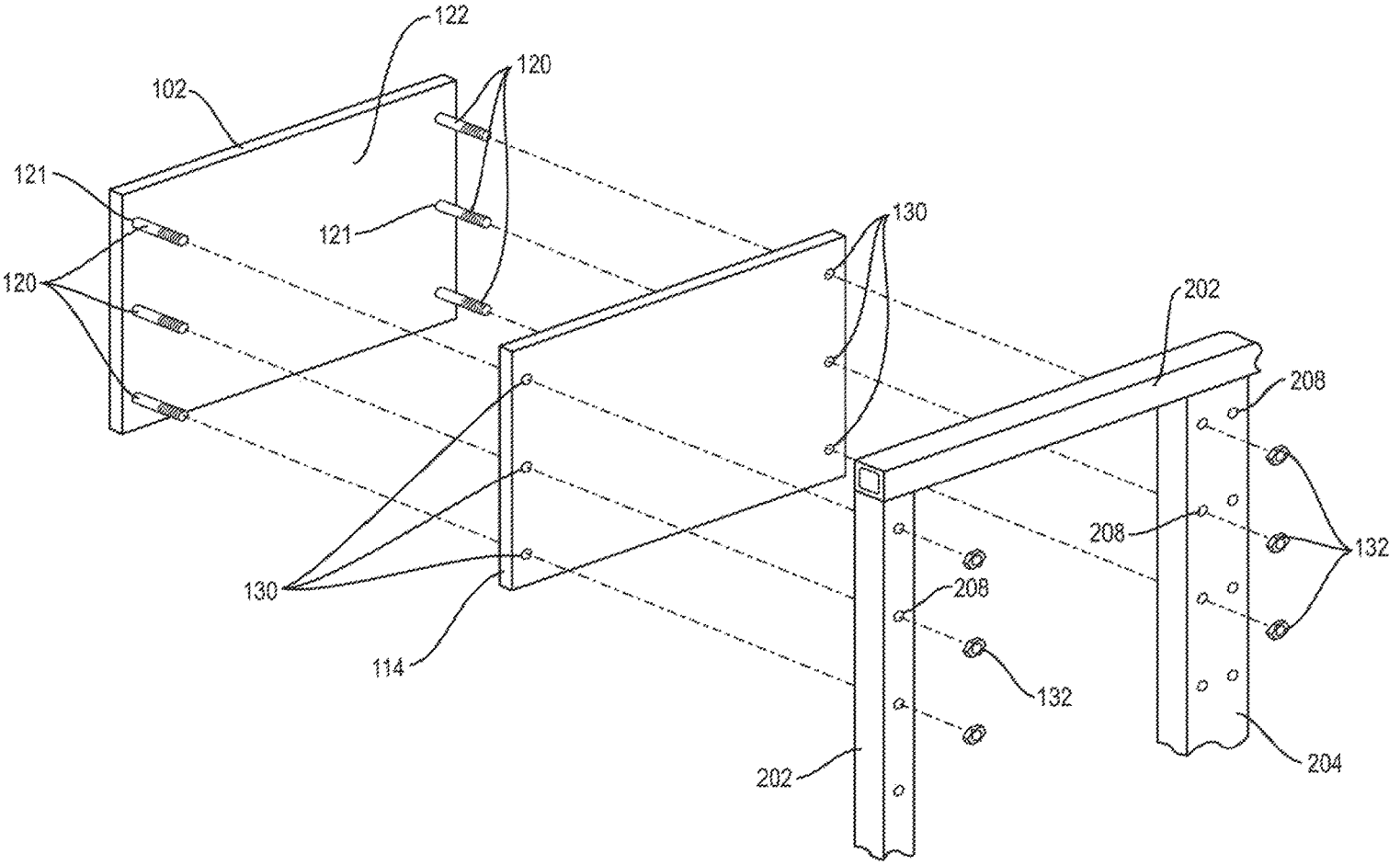
FIG. 3 shows the method by which a set of armor plates are mounted to the internal frame for the embodiment of the invention shown in FIG. 1.

As illustrated in FIG. 3, partially threaded rods 120 are inserted at a first of two ends into plate holes 121 formed partially or completely through the thickness of exterior plates 102 and are welded or otherwise affixed to the interior side 122 of armor plates 102. Again referring to FIG. 2, segments 202 and 204 define frame holes 208 therethrough such that said plate holes 121 are axially aligned with said frame holes 208 and such that said rods 120 pass through holes 130 defined by intermediate armor plates 114. As more clearly illustrated in FIG. 3, once the rods 120 pass through the frame holes 208 defined by segments 202 and 204 of the frame 200 the plates 102 and 114 are secured to the frame 200 by nuts 132 screwed onto said second end of threaded rods 120, said nuts 132 reversibly affixing said armor plates 102 and 114 to said frame 200.

Said plates 102 and 114 form a floor 150, a top 230 and at least three sides 201 when assembled. For this embodiment illustrated in FIG. 5, only armor plates 102 comprise the floor 150 and said plates 102 are affixed internal to said base 260 of said frame 200. The top plates, and plates 102 and 114 comprising the at least three sides of said shelter 100 are affixed external to said frame 200 such that said rods 120 extend into the interior 320 of said shelter 100 and are secured by nuts 132 which can be removed only by a person inside said shelter 100. This ability to detach said plates 102 and 114 from inside the shelter 100 is useul to allow a person or persons inside the shelter 100 to detach one or more of the sets of plates 102 and 114 thereby to escape from the shelter 100 in the event the door 104 of the shelter 100 becomes blocked. A tool tool to aid a person in detaching the plates 102 and 114 may be placed in the shelter.

In other embodiments of the invention the exterior armor plates 102 and intermediate plates 114 comprise one or more bullet proof grade materials chosen from the group ar400, ar450, ur500 and ar600 grade steel armor plates in thicknesses from ¼" to 1", other bullet-proof material such as LEXAN® sheets in thicknesses from ¼" to 1", metal foam approximately 1" thick, bullet resistant fiberglass in thicknesses from ¼" to 1", bullet proof plastic sheets up to 1" thick, KEVLAR® sheets in thicknesses from ¼" to 1", GRAPHENE® in multiple thin layers, carbon nanotube material in thicknesses from ¼" to 1", carbon fiber material up to 1" thick, and combinations thereof, in various embodiments of the invention. In other embodiments of the invention there may be no intermediate plates 114. By selection of appropriate materials and thicknesses thereof, the shelter 100 may be customized for desired level of protection from gunshot attack, and weight and cost of the shelter. The relative ease of attaching and removing armor plates 102 and 104 from the shelter 100 makes modification of the shelter 100 on site easy and permits individual shipment of parts which tend to be heavy.

When the shelter 100 is thus assembled the nuts 132 affixing the at least three sides and top of the shelter 100 can be accessed by a person inside the shelter 100 and can be unscrewed by said person who may then shove out the plates 102 and 114 away from the frame 200 thereby allowing a person or persons inside the shelter 100 to escape from the shelter 100. A tool for unscrewing the nuts 132 may be provided inside the safety shelter 100. Wing nuts or other fasteners known in the art may be substituted for the nuts 132, The ability of a person inside the shelter to unscrew one or more sets of plates 102 and 114 from the shelter 100 would be useful, for example, if the door 104 cannot be opened or has become blocked.

In other embodiments of the invention two or three intermediate armor plates 114 sandwiched between the outer plates 102 and the frame 200 may be installed when necessary for a particular purpose. The invention can thus be customized by selecting armor plates of various thicknesses and materials to provide different levels of protection from ballistic attack as desired. As will be understood by one skilled in the art, additional layers of armor plates 114 and/or additional thickness thereof increase the protection afforded to a person or people inside the safety shelter 100 from harm resulting from being targeted by more powerful ballistic weaponry or other form of attack.

Figure 4:
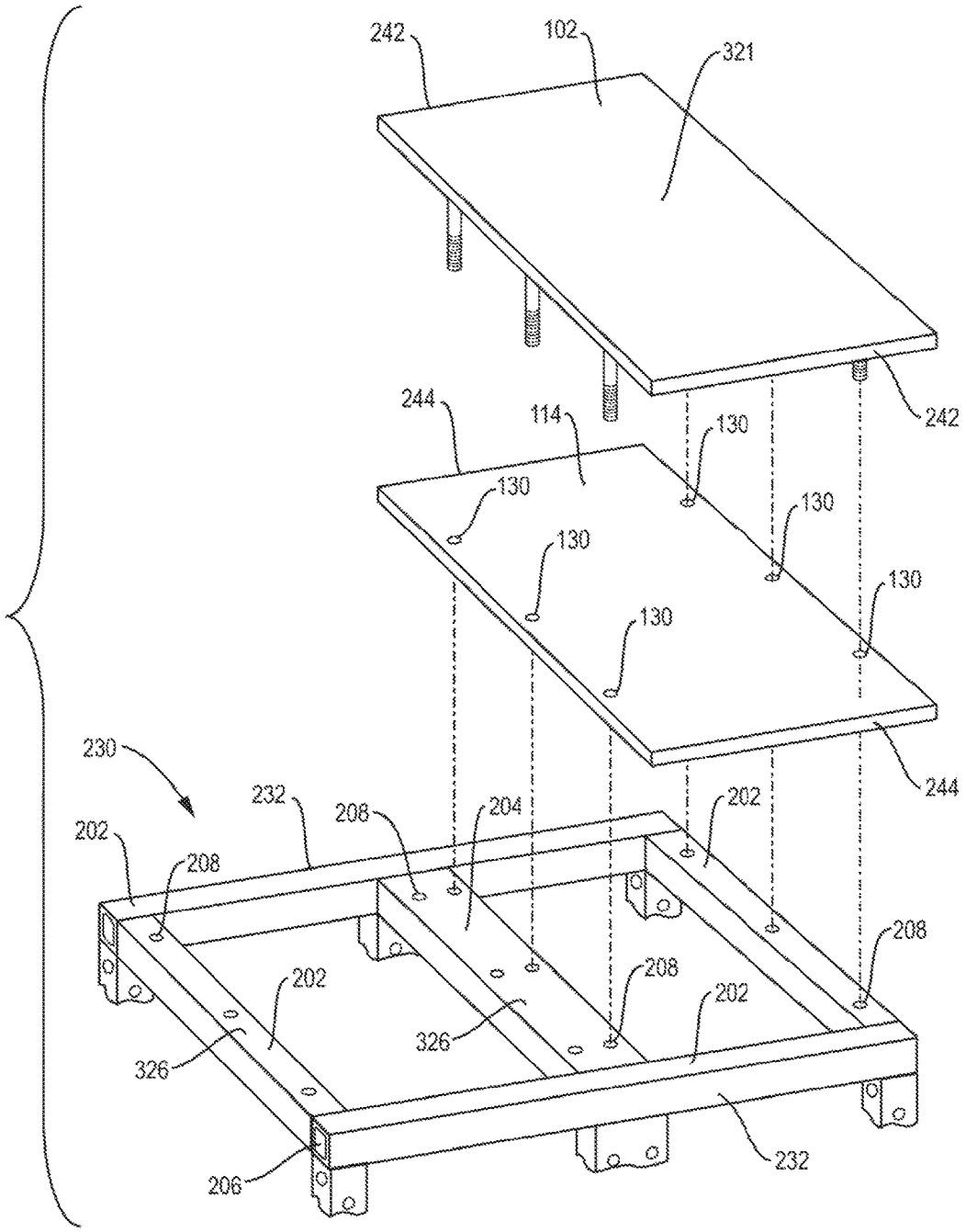
FIG. 4 is a top view of the top of the internal frame of the embodiment of the invention shown in FIG. 1 showing how a set of armor plates are assembled onto the top of the frame.

FIG. 4 illustrates the method of assembly of the armor plates 102 and 114 on the top part of the frame 230 in essentially the same manner as for the sides. When assembled, the plates 102 and 114 extend beyond the two sides 232 of the top frame 230 such that the edges 242 and 244 of the plates 102 and 114 are flush with the outer surface of the plates 250 (shown in FIG. 2) mounted on the sides of the frame 200. For the embodiment shown in FIGS. 2 and 3, there is an outer plate 102 and one intermediate plate 114, each of which is ¼" thick. Therefore each of the top plate's sides 242 and 244 would extend ½" beyond both sides 232 of the top portion of the frame 230 when mounted. Nuts 132 are screwed onto the rods 120 from inside the frame 200 to secure the plates 102 and 114 to the top of the frame 230. It is apparent from FIG. 4 that two sets of plates 102 and 114 are needed to cover the top of the frame 230 for the illustrated embodiment. When the plates 102 and 114 are mounted to the frame 200, the space 148 (FIG. 1) between adjacent plates is as small as reasonably possible.

Figure 5:
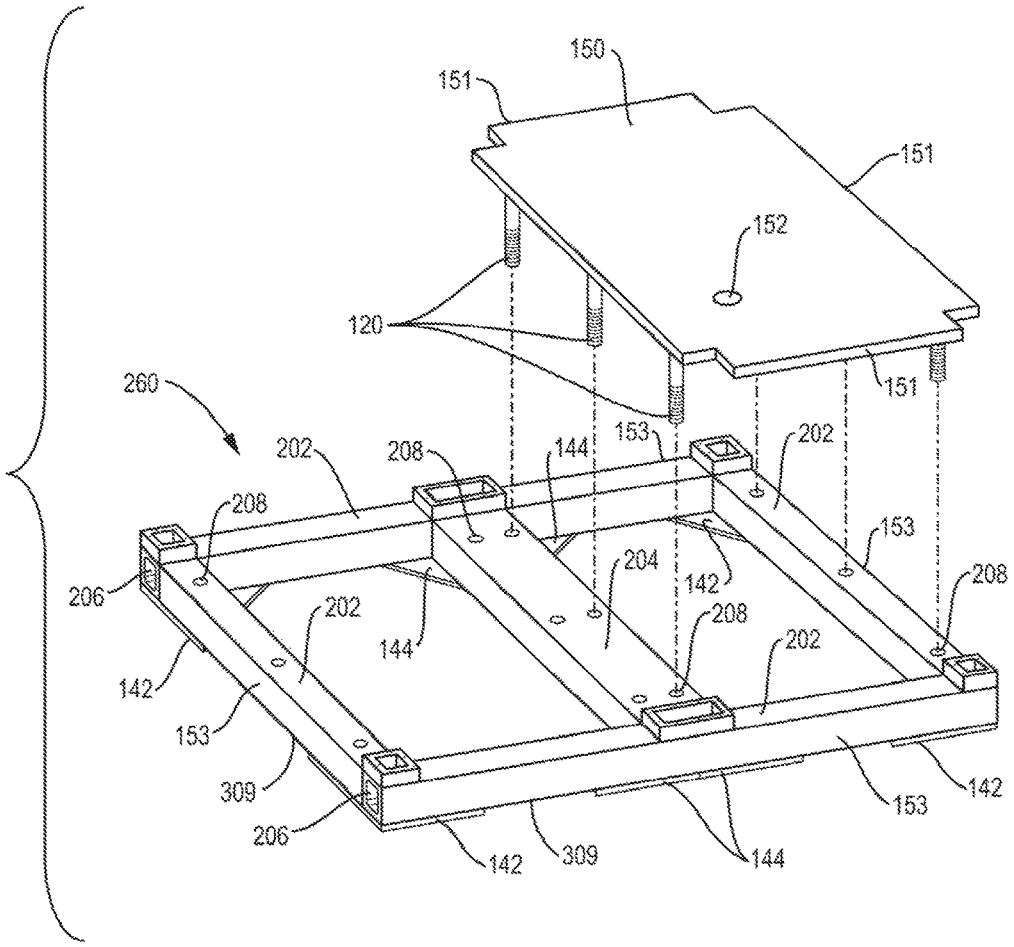
FIG. 5 is a sectional view of the base of the internal frame from the top for the embodiment of the invention shown in FIG. 1 and shows the positioning of a section of floor in the frame.

The assembly of the floor plates 150 into the bottom of the frame 260 is shown in FIG. 5. There is no intermediate plate 114 for the floor 150 of the cabinet 100 in this embodiment. In other possible embodiments additional thickness may be desired for the floor plates 150. Partially threaded rods 120 as shown bonded to exterior plate 102 in FIG. 3 extend from plate 150. The rods 120 extending from floor plates 150 are positioned to be axially aligned with holes 208 defined by frame segments 202 and 204 as shown for frame bottom 260, and the plates 150 are shaped to fit within the frame 200. In the embodiment shown, two floor plates 150 are secured to the bottom frame 260 with nuts 132 screwed to the rods 120 extending beneath the frame 260. The rods 120 may also pass through holes (not shown) defined through support plates 142 and 144 which are also shown in FIG. 1. Alternatively, the floor plates 150 may be welded to the frame bottom 260 such that no rods 120 or nuts 132 are required for their attachment. One or both of the two floor plates 150 define a hole 152 therethrough which is not readily visible to a potential attacker outside the shelter 100. The floor hole 152 provides air flow into and out of the shelter 100, provides hidden access for an electrical cable (not shown) into the shelter 100, and may serve as a hidden port to provide wireless or cable Internet or a phone cable or cell phone signal to an occupant or occupants of the shelter 100. The sides 151 of the floor panels 150 are flush with the sides 153 of the frame bottom 260 when assembled. At least four castors 140 are welded or otherwise affixed to the support plates 142 and 144 and secured to the frame 260. In other embodiments the support plates 142 and 144 may not be present and the castors 140 are affixed directly to the frame 260.

The front side 110 of the shelter 100 is illustrated in FIG. 6A. The top edge 306 of the door frame 300 extends beyond the top of the inner frame 200 such that the top edge of the door frame 300 is flush with the outer surface 321 (FIG. 4) of the plates 102 forming the top of the shelter 100. Likewise, the sides 308 of the door frame 300 extend beyond the sides 232 of the inner frame 200 such that the sides 308 of the door frame 300 are flush with the outer surface 250 of the plates 102 mounted to the left and right sides of the shelter 100. The bottom edge 310 of the door frame 300 may extend to cover the bottom 309 of the inner frame 200 as shown or, in other embodiments, may extend further. As shown in FIG. 6A, a door 104 is mounted to the inner frame 200 of the shelter 100 by hinges 106. A shield 113 having a knob 117 affixed thereto is mounted to the interior side 312 of the door 104 by a carbon steel bracket 115 affixed to the interior side 312 of the door 104, shown more clearly in FIG. 6B, such that the shield 113 covers the peephole 112 when in a closed position. An alternative design 282 for the bracket 115 is illustrated in FIG. 13B, said bracket also preferably being comprised of carbon steel. The shield 113 is preferably comprised of ½" thick ar500 grade armor plate, but may alternatively comprise bullet proof armor plate material as described for plates 102 and 114 and may have a different thickness as described for plates 102 and 114. A person inside the shelter 100 can expose the peephole 112 defined by the door 104 by sliding the shield 113 in the bracket 115 or 282. When the peephole 112 is exposed, a person or persons inside the shelter 100 can see outside the shelter and may engage an attacker outside the shelter 100 with a handgun or other weapon. The peephole 112 may then be covered again by sliding the shield 113 back over it.

The door frame 300 is mounted to the frame 200 as described for plates 102 and 114 and is comprised of an inner section 302 and an outer section 304, both preferably comprised of ¼" thick ar500 grade armor plates. The inner section 302 is wider than the outer section 304 thus providing a lip 314 against which the interior side 312 of the door 104 is held when the door 104 is in a closed and latched position. Inner section 302 defines holes therethrough as shown for plate 114 in FIG. 3. Partially threaded bolts 120 welded or otherwise affixed to the interior of outer section 304 at said one end as shown for plate 102 in FIG. 3 pass through said holes defined by said inner section 302 and frame holes 208 and are fixed to the inner frame 200 by nuts 132 screwed onto said second end of bolts 120 from the interior of the frame 320. For the embodiment shown in FIG. 6A, the door 104 is preferably comprised of ¼" thick ar500 grade armor plate. If a thicker door is desired, it will be apparent to one skilled in the art that additional plates of armor can be added to the door 104 and/or the door frame 110 to provide greater protection to an occupant or occupants without making the function of the shelter 100 apparent to a potential attacker by making the existence of a door 104 obvious. Likewise, thicker or thinner ar500 grade armor plates may be used or other bullet proof materials of various thicknesses substituted as previously noted. The outside 105 of the door 104 is flush with the outermost layer of the door frame 110 when it is in a closed position and such that there are minimum gaps 508 (FIG. 8) between the sides 322 and 324 of the armor plates to permit the door 104 to close tightly but not become stuck. The actual size of the gap 508 will depend on the thickness, shape and type of materials used. The sides 322 and 324 may also be cut at an angle.

Figure 11:
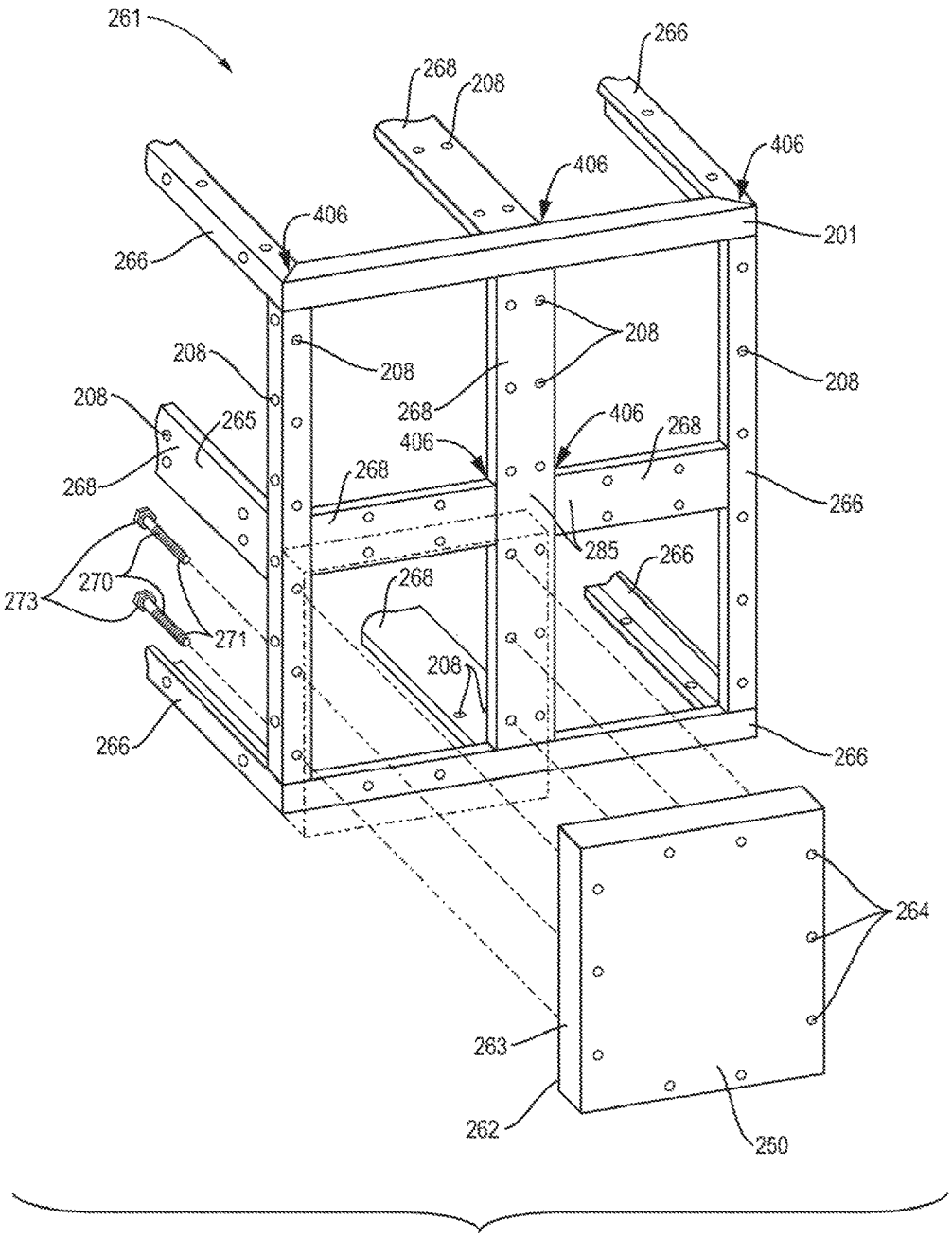
FIG. 11 shows a perspective view of an alternative embodiment of the interior frame for a single modular unit of the safety shelter according to the present invention and a method for affixing an armor plate thereto.
Figure 12:
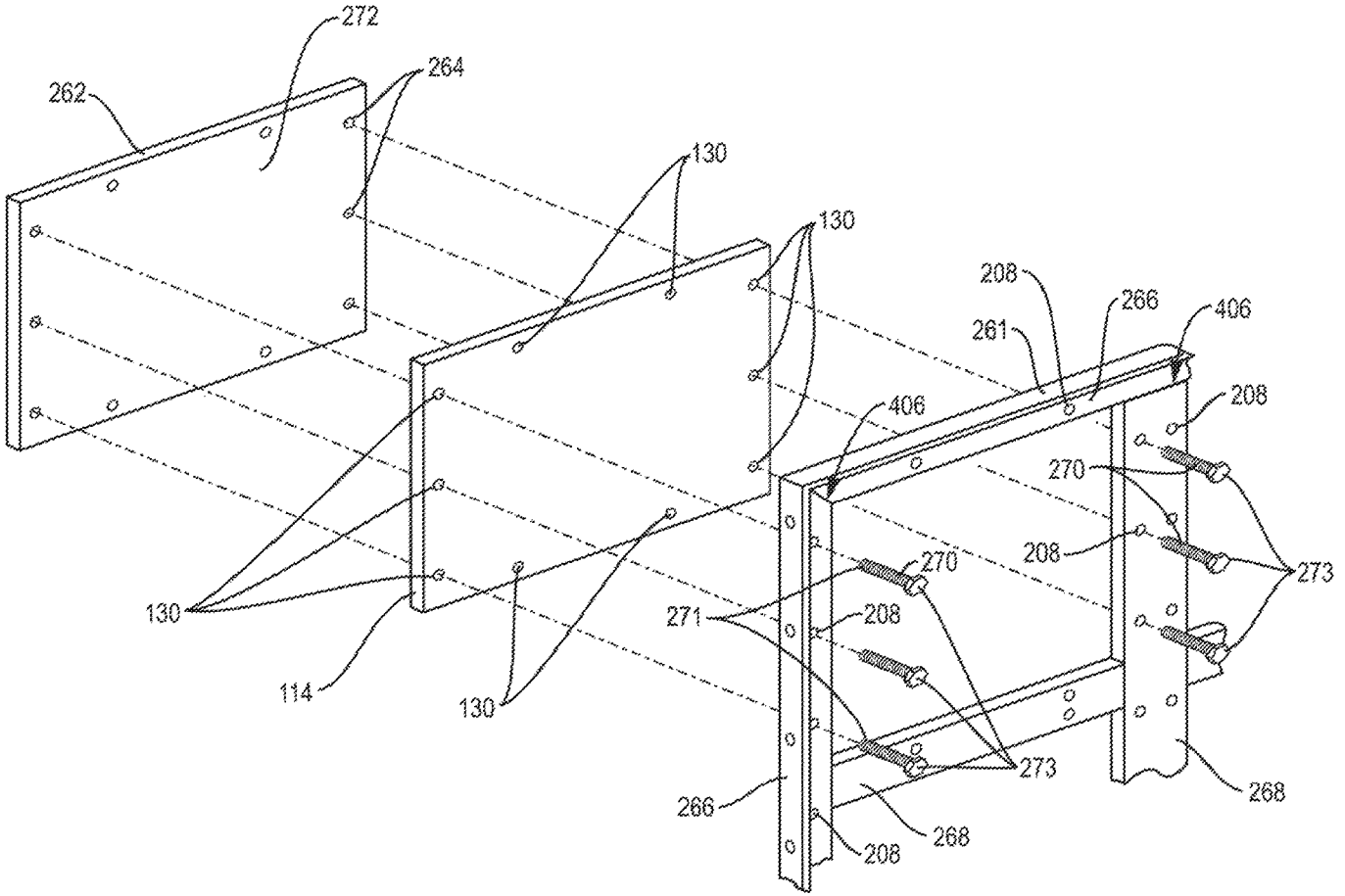
FIG. 12 illustrates a method of affixing an external armor plate and an intermediate plate to the exterior of a section of frame as shown in FIG. 11 using removable bolts.
Figure 13A:
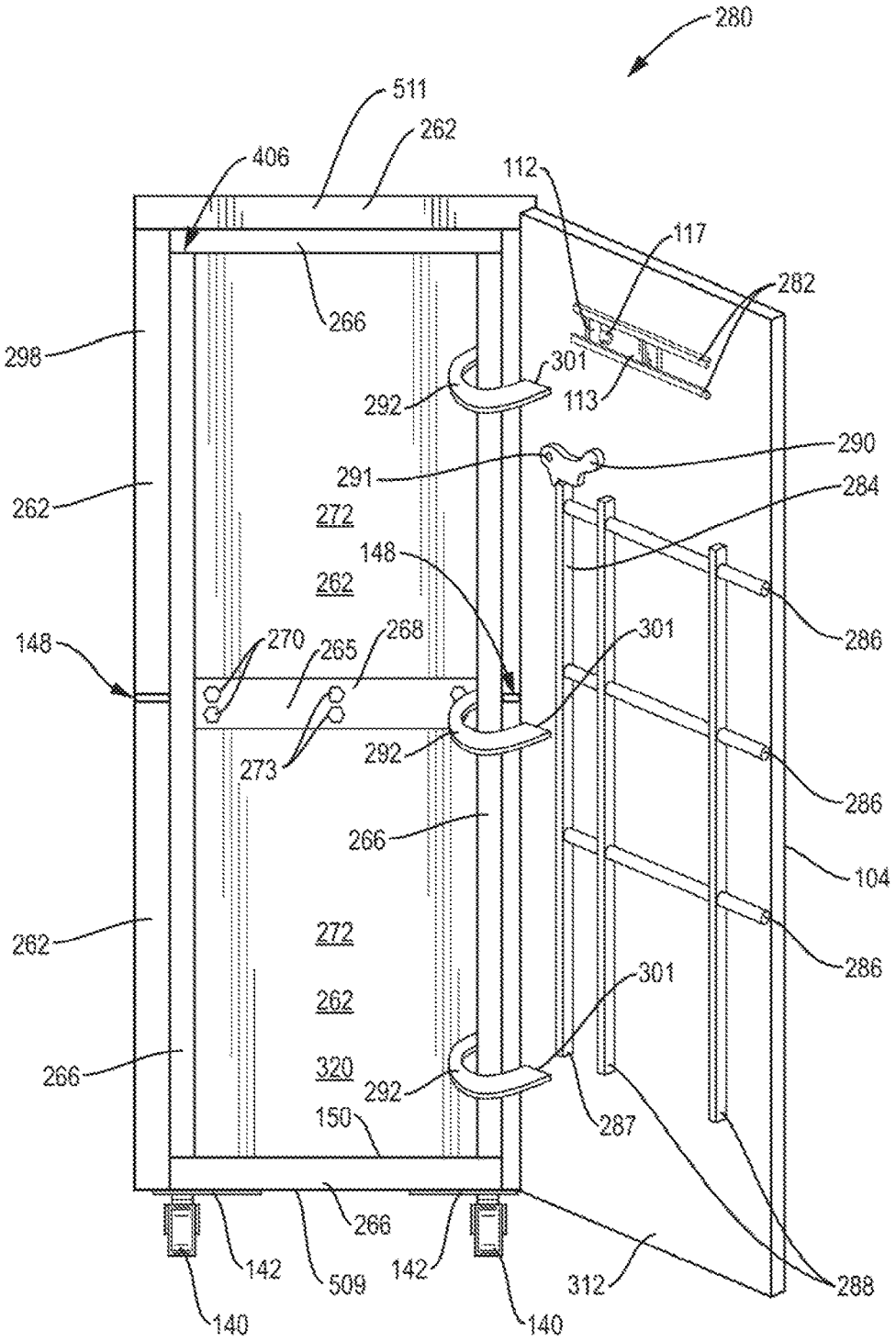
FIG. 13A illustrates a front view of the single modular shelter shown in part in FIGS. 11 and 12 as assembled with the door open and showing internal hinges and an alternative latch mechanism used to latch and lock the door from inside the shelter as part of the current invention.
Figure 13B:
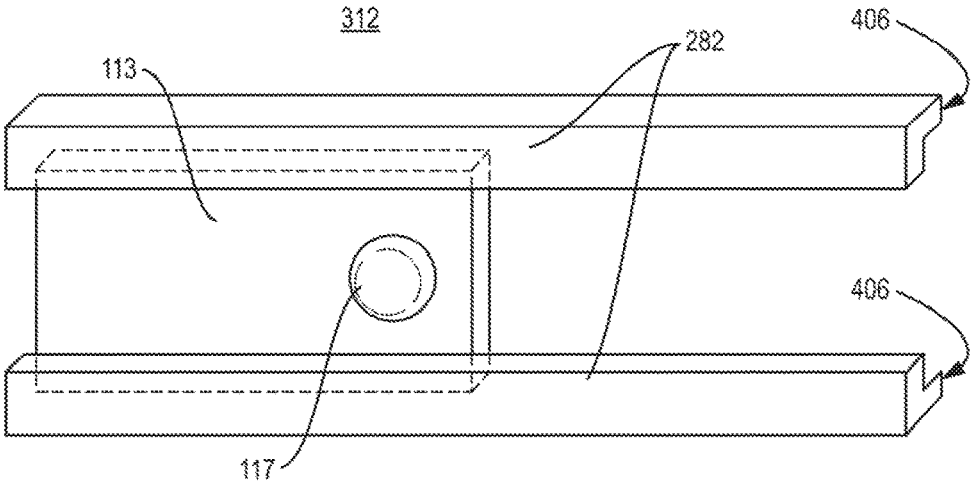
FIG. 13B shows an expanded view of a set of brackets shown in FIG. 13A affixing the peephole shield to the interior side of the door as an aspect of the present invention.

FIGS. 11 through 13 illustrate another possible embodiment of the invention. FIG. 13A shows a front view of a single unit safety shelter 280 resembling the single unit safety shelter shown in FIG. 6A. Unlike the shelter shown in FIG. 6A, for the shelter shown in FIG. 13A there is no door frame 300 and the door 104 covers the entire front side 298 of the shelter 280 when in a closed position. The door 104 and sides 262 may extend below the bottom 509 (FIG. 13A) of the frame 261 (FIG. 11) so as to better hide the castors 140 from being discovered by a potential attacker. An alternative embodiment of the bracket 115 slidingly affixing the shield 113 over the peephole 112 defined by the door 104 is shown in FIG. 13A as brackets 282, the brackets 282 being welded or otherwise affixed to the interior side 312 of the door 104 as shown more clearly in FIG. 13B. The brackets 282 are preferably comprised of carbon steel.

Also illustrated in FIG. 13A is an alternative sliding latch mechanism 284 comprising latch rods 286 affixed at one of two ends to a bracket 287, such that said rods 286 slide in latch supports 288 affixed to the interior side 312 of the door 104. When the door 104 is in a closed position, a person inside the shelter 280 may slide the latch rods 286 such that second ends thereof come against the interior side of the frame member 266 thereby latching the door 104. When the sliding latch 284 is so latched, a locking device 290, which pivots about a point 291 attaching the locking device 290 to the interior side 312 of the door 104, may be rotated about the pivot 291 to lock the latch mechanism 284. A person in the interior 320 of the shelter 280, when thus locked inside said shelter 280. may disengage the lock mechanism 290 and slide the latch 284 to open the door 104 and exit the shelter 280. Neither of the illustrated latches 108 or 284 can be seen or unlatched by a person outside the closed shelter 100 or 280.

In any of the embodiments of the invention the hinges 106 (FIG. 6A) or 292 (FIGS. 13A and 13C) may be affixed to either the right hand side of the door 104 as shown in FIG. 6A or to the left hand side of the door 104 (not shown). The hinges 106 are preferably not visible or accessible from the exterior of said shelter 100 and the hinges 292 are not visible or accessible from the exterior of said shelter 280 when the door 104 is in a closed position.

Figure 13C:
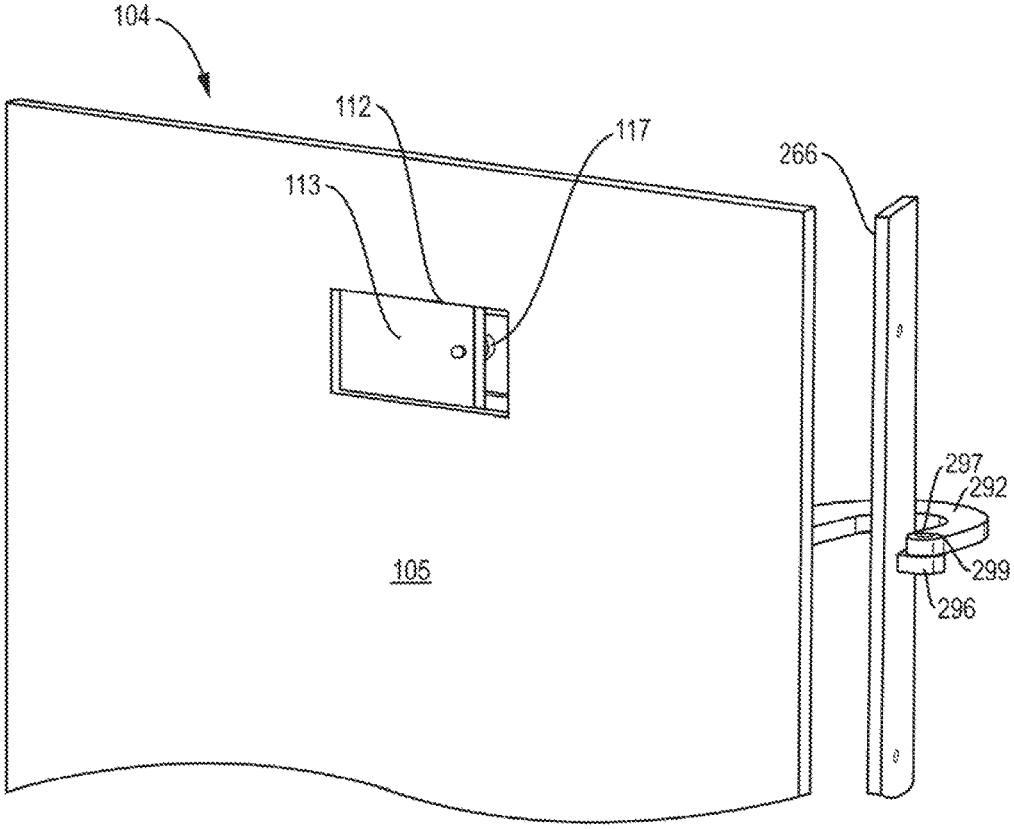
FIG. 13C illustrates a cut away perspective of the structure by which the internal hinges of FIG. 13A are mounted to the internal frame of this embodiment of the invention.

A more detailed illustration of the manner in which the hinges 292 may be affixed to a frame member 266 of the internal frame 261 is given in FIG. 13C. A mount 296 having a cylindrical protrusion 297 is affixed to the frame 266 such that the hinge 292 defining a hole 299 fits over the protrusion 297. The hinge 292 rotates on the protrusion 297 of the mount 296 such that the door 104 may be opened and closed. The other end 301 (FIG. 13A) of the hinges 292 is affixed to the interior side 312 of the door 104. The hinges 297 may be rotatably affixed to the mounts 296 by means known in the art such that the door 104 may not be lifted off the protrusions 297 of the mounts 296, although such a structure may not be needed since the door 104 is generally heavy being preferably comprised of ar500 grade armor plate which is at least ¼" thick, and said door, when latched, would be held firmly against the front 298 of the rest of the shelter.

The construction of the back 114 (interior, FIG. 6A) of the shelter 100 is essentially the same as described for the top of the shelter as shown in FIG. 4. The difference is that, in addition to the plates 102 and 114 extending beyond the sides 232 of the inner frame 200 so as to be flush with the outer surface 250 of the external plates 102, the top back set of plates 102 and 114 extend beyond the top 326 of the inner frame 200 so that the top edges 328 and 330 of the plates 102 and 114 are flush with the top surface 321 of the outer plates 102 mounted to the top of the shelter 100 thus giving the visible external part of the shelter 100 square corners. As will be apparent to one skilled in the art, the square corners or the appearance thereof can be achieved by adjustments to the illustrated embodiments without departing from the scope of the invention herein disclosed. One such adjustment would be to cut one or more edges 263 (FIG. 11) of exterior armor plate 262 (FIG. 11) at a 45 degree slant such that when two exterior plates 262 are mounted perpendicular to each other on, for example, one side 201 and the back 265 of the frame 260 (FIG. 11) the edges 263 come together to comprise a square corner.

An additional benefit of having multiple sets of armor plates 102 and 114 that can be detached by a person inside the safety shelter 100 derives from the fact that the ¼" thick ar500 grade armor plates are heavy. The other possible materials, as noted, tend to be lighter. An appropriate embodiment of the invention can be shipped partially unassembled to a customer and set up at its destination as described without the need for specialized lifting equipment or the convenience of an elevator able to move the assembled shelter 100 or other embodiments of the invention as shown or described herein.

The embodiment of the invention as shown in FIG. 1 has castors 140 welded to the internal frame 200, said castors 140 attached through support plates 142 or 144 which can also function to reinforce the frame 200. The castors 140 provide for movement of the frame 200 prior to assembly of the panels 102 and 114 onto the frame 200 and for movement of the assembled shelter 100. Movement of the shelter 100 may be prevented by locking down the castors' breaks 146 if the castors have breaks or by other means knownin the art.

Figure 7:
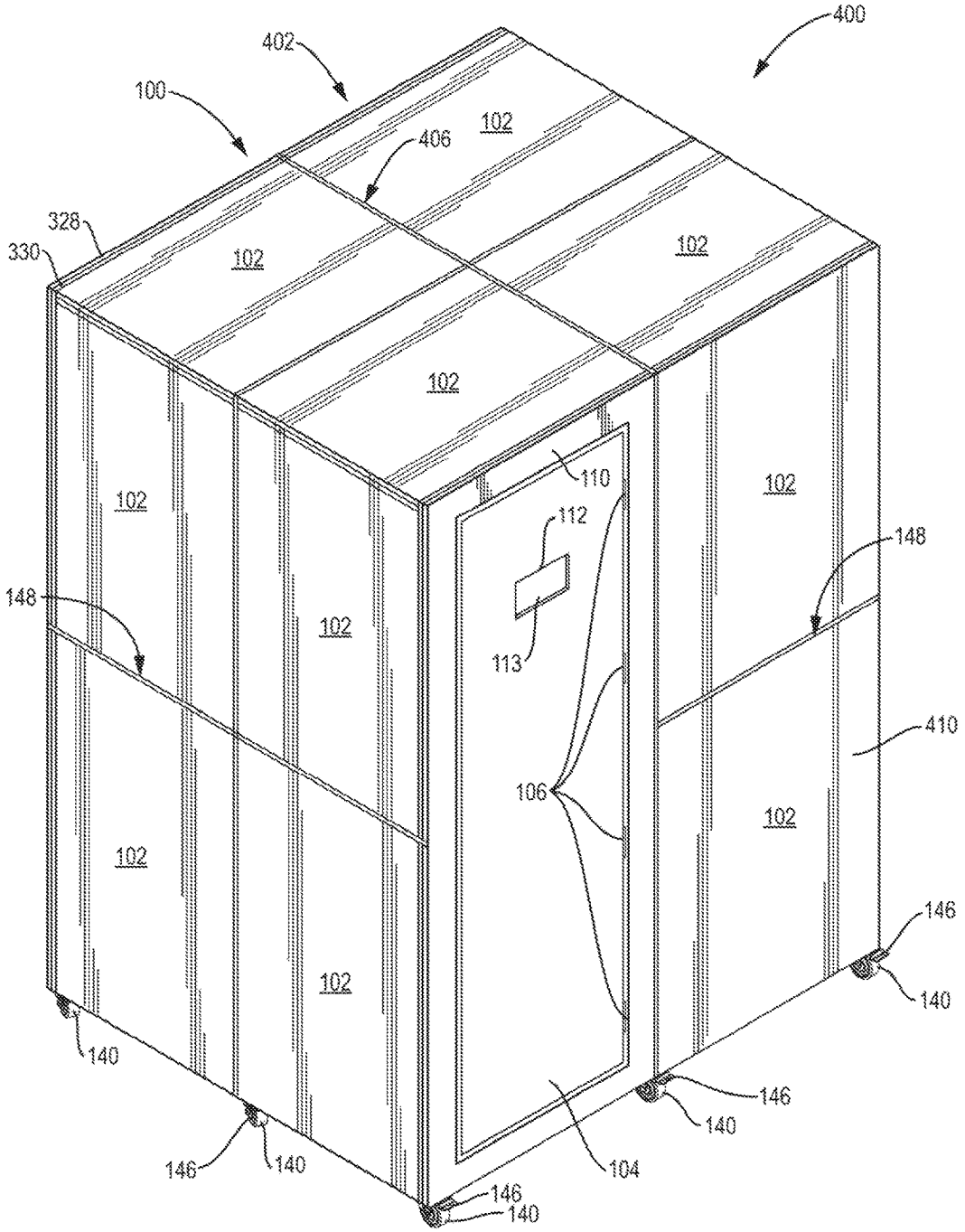
FIG. 7 shows an embodiment of the present invention in which multiple modules of the safety shelter are affixed together without intervening armor plates.
Figure 9:
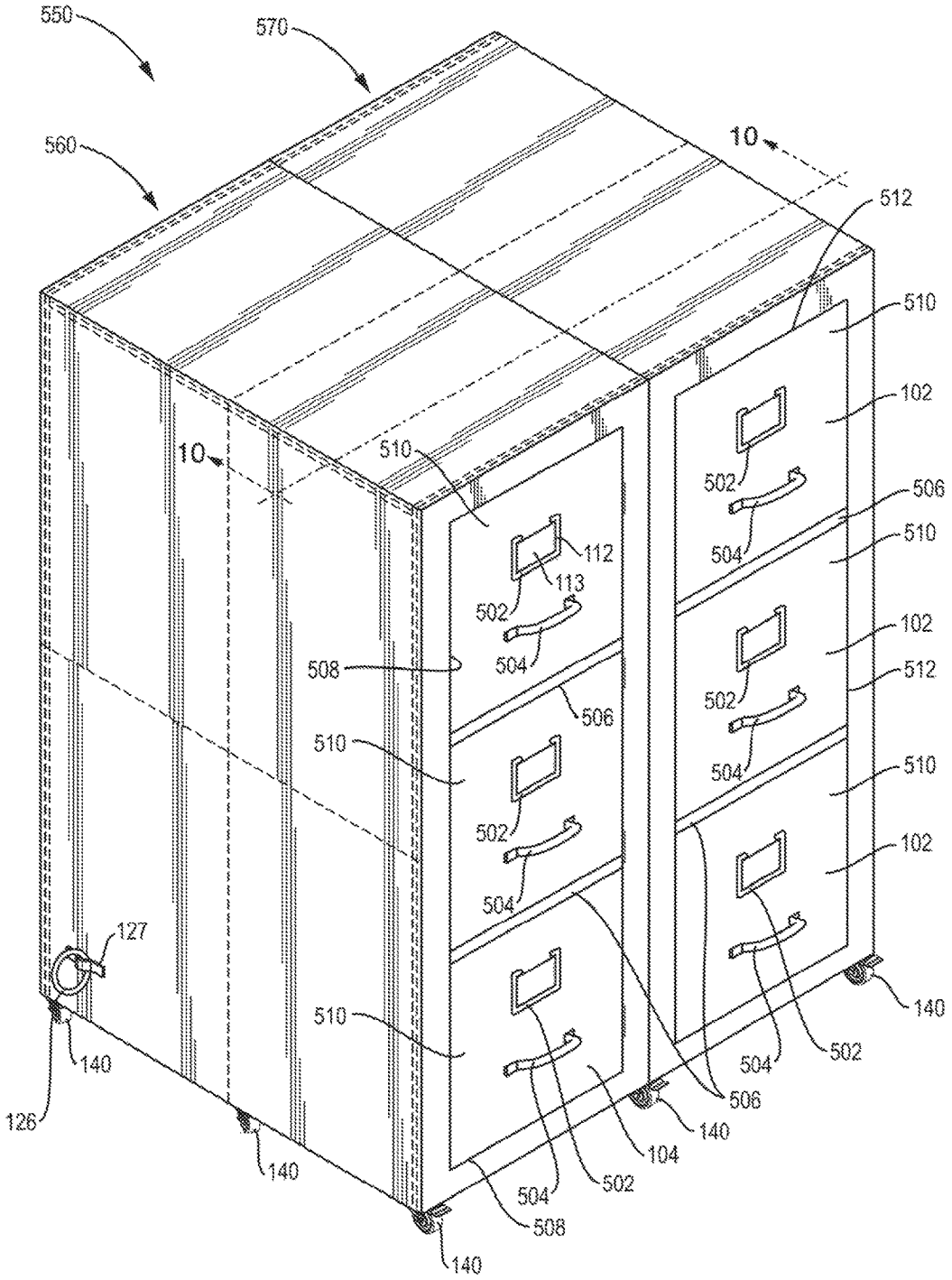
FIG. 9 shows an embodiment of the present invention as shown in FIG, 7 with decorative elements added to further disguise the safety shelter as a set of file cabinets with two modular units.

In other embodiments of the invention, shown for example in FIG. 7, a modular safety shelter 100 as shown in FIG. 1 may be combined with one or more additional modular units 402 so as to define a larger interior space 320 (FIG. 6A) within the multi module unit 400 without departing from the disguise function of the shelter 100 or 400. As shown in FIG. 7, when two or more units 100 and 402 are combined, it is not necessary to have more than one door 104, but the invention does not exclude the possibility that more than one door 104 will be incorporated into a multiunit assembly such as the example 400 shown. In such a multiunit shelter 400 the internal frames 200 (see FIG. 10) of the units 100 and 402 are bolted or welded together in the region 406 in between the two units 100 and 402 and there are no armor plates 102 or 114 mounted to the abutting sides 232 in the region 406 of the two units 100 and 402. This concept is illustrated more clearly in FIG. 10, a sectional perspective view along line 10-10 of FIG. 9 of the shelter 550 in which a portion of the front of the assembly has been cut away to show the interior 320. As will be described, multiunit shelter 550 illustrated in FIG. 9 is the same as the multiunit shelter of FIG. 7 additionally comprising disguise elements included to make the shelter 550 appear more like a set of file cabinets.

Figure 10:
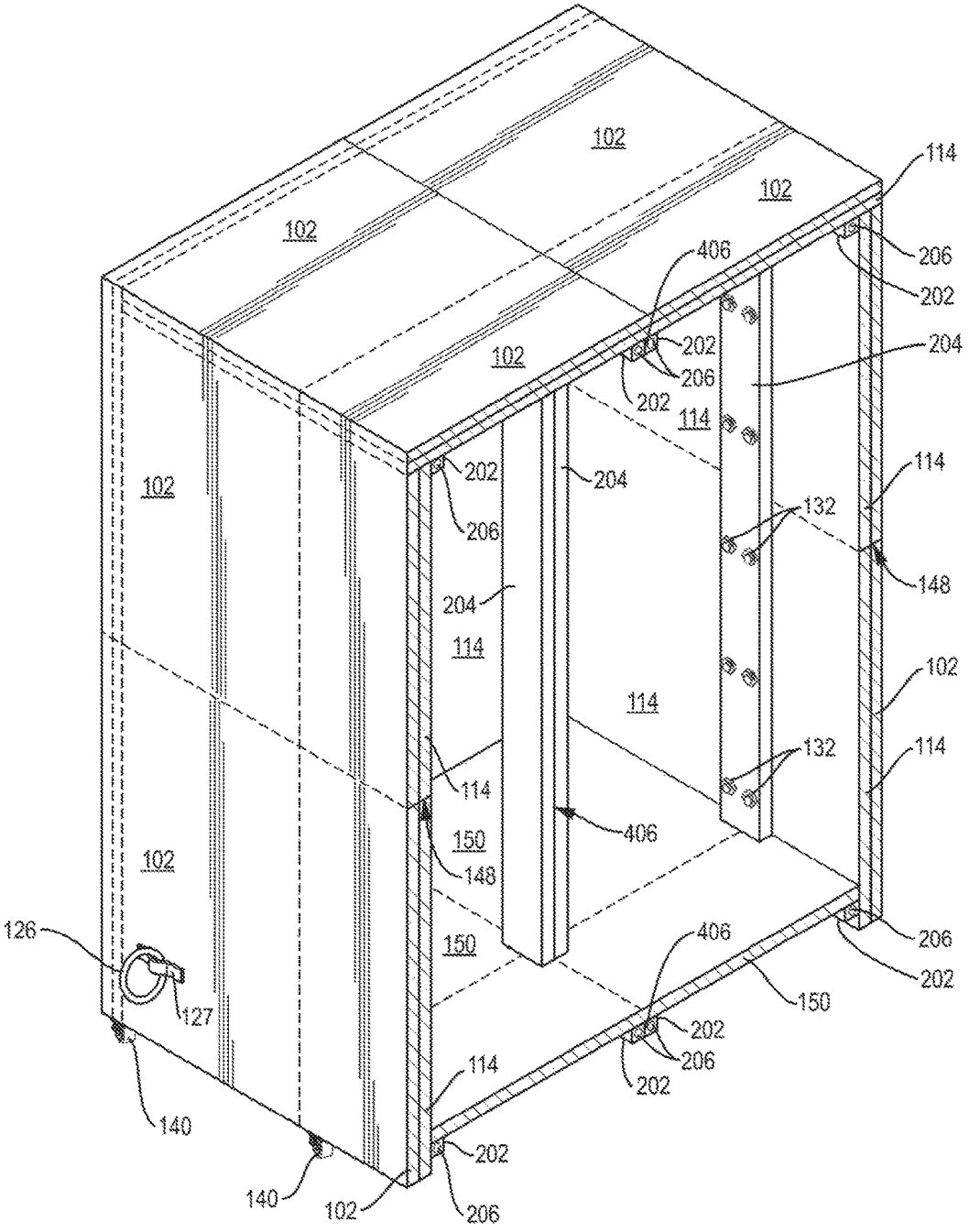
FIG. 10 illustrates a cut away perspective front view of the invention as shown in FIG. 9 along the line 10-10, showing a support structure in the center.

Additionally, as will be understood by one of ordinary skill in the art, the armor plates 102 and 114 mounted to the front 110 and 410, top 230 (FIG. 4) and back 114 (internal, FIG. 6A) or 262 (internal, FIG. 13A) do not extend beyond the inner frames 200 where the units 100 and 402 abut and are joined together 406. In the various embodiments encompassed within the scope of this invention, the support plates 142 and 144 may not be present or a differently shaped support plate 148 (FIG. 7) may be useful in supporting and stabilizing joined units such as 100 and 402 of the shelter 400. The front of frame 200 in modular unit 402 of shelter 400, which does not define a door in this embodiment, may additionally comprise a frame member 204 defining holes 208 in the region 148 where the sets of plates 102 and 114 come together as illustrated for the back side 114 (interior, FIG. 6A). The same is true for embodiments of the invention comprising the frame elements 266 and 268 as shown in FIGS. 11, 12 and 13 when included in a multiunit shelter. Further, the center support elements 204 affixed together 406 as shown in FIG. 10 may not be included in some multiunit shelters. The same is true for modular units 280 (FIG. 13A) comprising a frame 261 (FIG. 11) having L-brackets 266 and straps 268 welded together or otherwise affixed in which the straps 285 comprising one or both sides 201 will generally not be included where two such units 280 abut.

This additional embodiment of the invention is illustrated in FIGS. 11 through 13. The shape of the frame members 266 and 268, both comprised of carbon steel and shaped as L-brackets 266 or rectangular straps 268, differ in this embodiment but have the same function as frame members 202 and 204 already described. As shown in FIG. 11, the frame members 266 and 268 are affixed together, preferably by welding, and said frame members 266 and 268 define frame holes 208 therethrougth. The frame 261 is in the shape of a file cabinet and defines a rectangular base, four sides, a top and an open interior 320, one of said sides defining a door frame.

Compared to FIG. FIG. 11 illustrates an alternative means for attachment of an armor plate 262, preferably comprised of ½" thick ar500 grade armor, to one side 201 of the frame 261. As shown in FIG. 12, armor plates 262 define plate holes 264 partially or completely through the interior side 272 of the plates 262. In this embodiment the plate holes 264 are threaded so as to engage one of two ends 271 of a bolt 270 first passing through a frame hole 208 axially aligned with the plate hole 264. The bolts 270 each have a head 273 at said second end which, when a bolt 270 passes through a frame hole 208 and is screwed from the interior of the frame 320 into a plate hole 264, removably affixes an armor plate 262 to the exterior of the frame 261. As is also true for the embodiment of FIG. 2, a person in the interior 320 of the shelter 280 can thereby unscrew the bolts 270 from one or more plates 262 comprising the at least three sides and the top of the shelter 280. Again, this feature of the invention allows an alternative way for a person in the interior 320 of the shelter 280 to escape from the shelter 280 if the door 104 becomes obstructed. Various other advantages of this feature of the invention have been previously described.

FIG. 12, which is similar to FIG. 3, illustrates an intermediate armor plate 114 defining holes 130 therethrough being mounted to a section of the frame 261 in between exterior plate 262 and the frame 261 and affixed to the frame 261 by bolts 270 passing through frame holes 208. A front view of a single modular unit of the shelter 280 is illustrated in FIG. 13A where no intermediate plates 114 are used. The back 265 (FIG. 11), sides 201 and top 511 of the shelter 280 are comprised of armor plates 262 preferably consisting of ½" thick ar500 grade armor plates, The floor plates 150 may be affixed interior to the base 509 of the frame 261 and screwed on by bolts 270 engaging threaded plate holes 264 or the floor plates 150 may be welded to the frame 261.

Since numerous combinations of modular units 100, 402 and multiple other possible embodiments not illustrated herein are within the scope of this invention, it will now be apparent to one skilled in the art that modifications may be made to the internal frame 200 or 261 and the way in which the armor plates 102 and/or 114 are shaped to suit the needs of any particular customer. The thickness of the armor protecting the shelter 100, 400 or 280 may be increased to provide greater safety from gunshot or other attack to a potential occupant or occupants by adding one or more additional armor plates 114 to the sets of plates 102 and 114 mounted to the internal frame 200 or 261. In other situations there may be no intermediate plates 114 and the composition and thickness of exterior armor plates 102 may be selected from among the noted options such that the shelter is customized for a particular customer's needs. Further, because the armor plates 102, 114 and 262 are relatively easy to install and remove when the shelter 100, 400 or 280 is in the customer's home or office, the shelter 100, 400 or 280 can be modified on location by removing plates 102 and 114 and replacing them with plates 102, or 102 and 114, comprised of different materials as previously defined and having different thicknesses as noted. The thicknesses of the armor plates 102, 104 and 262 chosen may be decreased to produce, for example, a lighter shelter or a less expensive product. In another possible variation of the illustrated embodiments, especially suitable for a multiunit shelter, a peephole 112, protected by a shield 113, is defined by one or more sides 102 or 262 instead of or in addition to a peephole or peepholes 112 defined by one or more doors 104.

Figure 8:
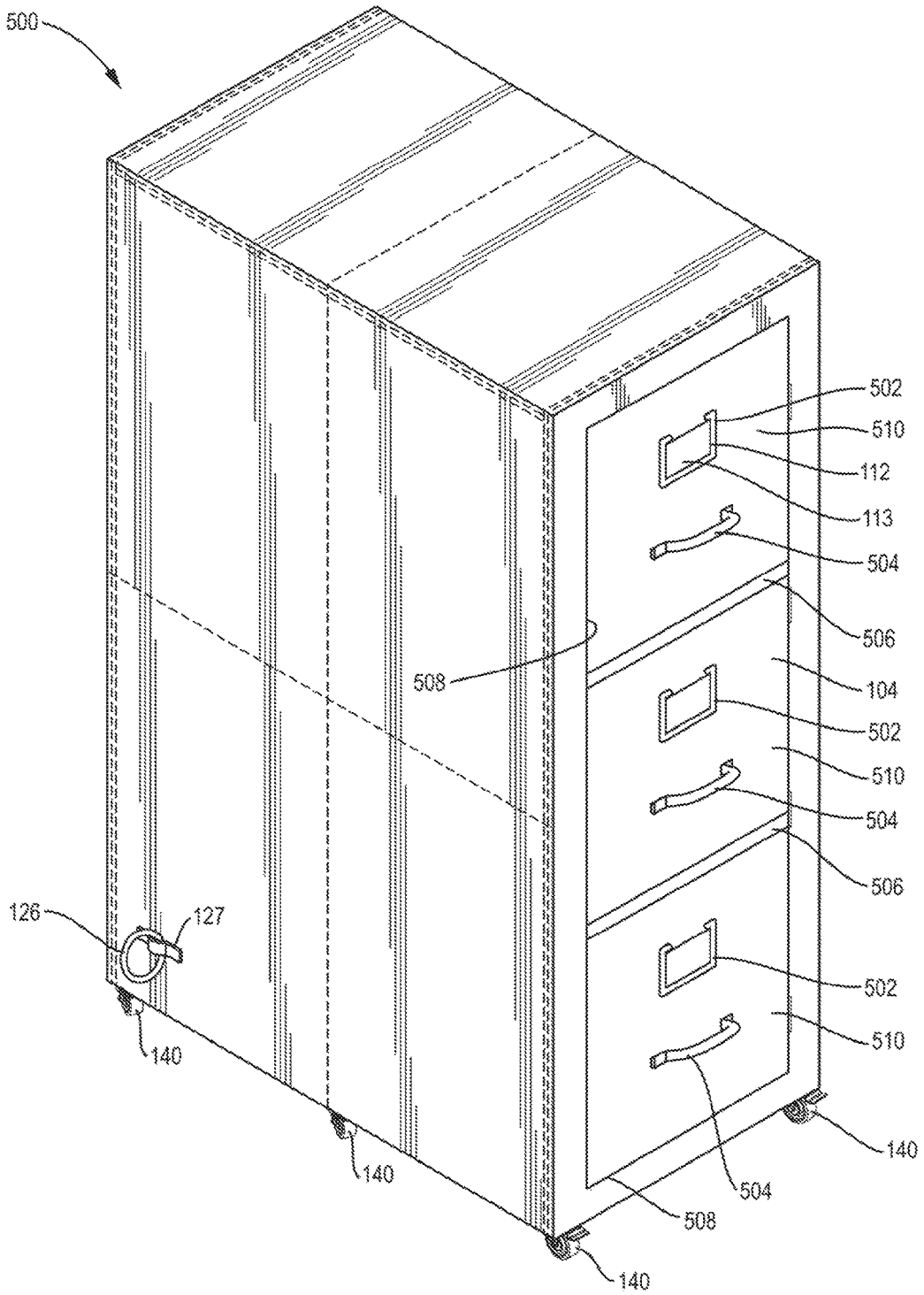
FIG. 8 shows an embodiment of the present invention as shown in FIG. 1 with decorative elements added to further disguise the shelter as a file cabinet.

As shown in FIGS. 8 and 9, another useful feature of the present invention is that the safety cabinet 500 or 550 appears to be an ordinary piece of office furniture such as a file cabinet (FIG. 8) or set of file cabinets (FIG. 9). It is understood that this invention includes within its scope various disguises added to the safety shelter 100, 400 or 280 including but not limited to painting the exterior, adding handles 504 or knobs (not shown) which are preferably not functional, and adding other features which do not otherwise interfere with the functions of the invention described herein generally to enhance the degree to which the safety shelter 100, 400 or 280 blends into its surroundings so that the true function of the invention—hiding and protecting one or more persons inside it—does not become apparent to an intruder who might otherwise seek to harm the occupant or occupants. As shown in FIG. 8, the external outline 508 of the door 104 together with strips 506 outline false file drawers 510. This disguise is enhanced by file drawer label holders 502 and handles 504 for each "drawer" 510. The uppermost label holder 502 on the finished shelter 500 may be positioned to hide the peephole 112 defined by the door 104 in some possible embodiments. The other label holders 502 and handles 504 may be likewise positioned so that the false file drawers 510 appear alike and appear to form a typical closed file cabinet.

The disguise for a two or more unit cabinet 400 (FIG. 7) may be much like that for the single unit 500 shown in FIG. 8. As shown in FIG. 9, the disguise elements for the unit 560 with the door 104 defining the peephole 112 may appear the same as in FIG. 8. The other module 570 may appear essentially the same as modular unit 560, except that since there is no door 104 on the front side 410 in this embodiment, armor plates 102 or 262, or 102 and 114, cover the front side 410 as described for the back side of the shelter 400 and the other three sides of the shelter 400. On the front 410 of the modular unit 570 the edges 512 of the false file drawers 510 may be added to the disguise. These edges 512 may be painted on, taped on or applied by other methods known in the art. Adhesive tape might also be added to cover any visible gap 148 between the outer plates 102 or plate edges 328 and 330 on the front, back, sides and top of the shelter 400.

The interior features of the combined modular units 550 are shown more clearly in in FIG. 10 where the front part of the shelter 550 has been cut away along line 10-10 shown in FIG. 9. As shown, the abutting segments 202 and 204 of the interior frames 200 are welded together as indicated by the numeral 406. Thus the segments 204 welded together in the center of the structure provide support at the center of the structure 550. Other embodiments may not have this center support or the center support or supports may have other coonfigurations. An interior light (not shown) may be added to the various embodiments of this invention.

While the present invention has been disclosed, illustrated and described in terms of certain embodiments and modifications thereof, the scope of the invention is not limited by such embodiments or modifications thereof, and such other embodiments or modifications as may be suggested by the teachings herein are particularly reserved especially when they fall within the scope and breadth of the claims here appended.

I claim:

1. A customized, modifiable, bullet-proof, moveable, free-standing, indoor safety shelter in the shape of a file cabinet for shielding a person or persons inside the shelter both from being detected by an intruder and from being harmed by a gunshot or other attack during a home or office invasion, said shelter comprising:

a frame comprised of one of carbon steel and aluminum members affixed together in the shape of a file cabinet, said frame defining a rectangular base, four sides, a top and an open interior, one of said sides defining a door frame and said frame members defining frame holes;

armor plates forming a top and at least three sides of said shelter having interior and exterior sides and consisting of one bullet proof material chosen from the group ar400, ar450, arand ar600 grade steel armor plates in thicknesses from ¼" to 1", other bullet-proof material such as LEXAN® sheets in thicknesses from ¼" to 1", metal foam approximately 1" thick, bullet resistant fiberglass in thicknesses from ¼" to 1", bullet proof plastic sheets up to 1" thick, KEVLAR® sheets in thicknesses from ¼" to 1", GRAPHENE® in multiple thin layers, carbon nanotube material in thicknesses from ¼" to 1", and carbon fiber material up to 1" thick, said plates defining plate holes extending partially or completely through the thickness of said plates, said plate holes being defined on the interior side of said plates and being axially aligned with said frame holes and affixed external to said frame via one of threaded rods and bolts affixed to said plate holes at one of two ends and passing through and extending beyond said frame holes at said second end and secured at said second end such that said plates comprising at least three sides and said top are removable by a person or persons in the interior of said shelter, said choice of armor plate material and thicknesses thereof providing for customization of said shelter for desired level of protection from gunshot attack, weight and cost of said shelter, and ease of modifying said shelter;

a floor being affixed internal to said base of said frame; and a door generally consisting of the same bullet proof armor as the sides and top and appearing to be similar to said other at least three sides of said shelter when in a closed position, said door having interor and exterior sides and being affixed to said side of said frame defining said door frame by hinges, said hinges not being readily visible or accessible to a potential attacker when said door is in a closed position, said door having a sliding door latch affixed to the interior side of said door by one or more brackets, said door latch being operable to slidingly latch or unlatch said door only by a person or persons inside said shelter when said door is in a closed position.

2. The safety shelter of claim 1 additionally comprising at least four castors affixed to said base of said frame, said castors being essentially hidden from a potential attacker located outside said shelter.

3. The safety shelter of claim 1 additionally comprising a hole defined by said floor open to the exterior of said shelter, said floor hole not being readily visible to a potential attacker outside the shelter, and said floor hole providing for exchange of air into the shelter and providing a person or persons inside the shelter hidden access to a source of power, phone and intenet services.

4. The safety shelter of claim 1 further comprising a peephole defined by said door, said peephole being covered by a shield consisting of one of said armor plate materials and a grip affixed thereto, and said shield being affixed to the interior side of said door by a bracket or brackets such that a person or persons inside said shelter can expose said peephole thereby allowing said person to see outside the shelter and target a potential attacker outside said shelter with a weapon such as a handgun while in the shelter and again cover said peephole.

5. The safety shelter of claim 1 additionally comprising one or more decorative elements, such as false file drawer handles, file drawer labels, paint or false file drawer outlines, which thereby enhance the deceptive appearance of said safety shelter as being an ordinary file cabinet.

6. The safety shelter of claim 1 additionally comprising a security ring permanently affixed to the exterior of said shelter by a bracket.

7. The safety shelter of claim 1 additionally comprising one or more sets of armor plates each consisting of one bullet proof grade material chosen from the group ar400, ar450, ar500 and ar600 grade steel armor plates in thicknesses from ¼" to 1", other bullet-proof material such as LEXAN® sheets in thicknesses from ¼" to 1", metal foam approximately 1" thick, bullet resistant fiberglass in thicknesses from ¼" to 1", bullet proof plastic sheets up to 1" thick, KEVLAR® sheets in thicknesses from ¼" to 1", GRAPHENE® in multiple thin layers, carbon nanotube material in thicknesses from ¼" to 1", and carbon fiber material up to 1" thick, and each plate defining plate holes extending completely through the thickness of said plates and sandwiched in between the external armor plates comprising the sides or top of said safety shelter and said frame, said intermediate plates defining said through holes axially aligned with said frame holes for mounting said plates.

8. A customized, modular, modifiable, bullet-proof, moveable, free-standing, indoor safety shelter in the shape of a set of two or more file cabinets for shielding a person or persons inside the shelter both from discovery by an intruder and from being harmed by gunshot or other attack during a home or office invasion, said shelter comprising:

two or more substantially similar single unit frames each in the shape of a file cabinet consisting of one of carbon steel and aluminum members permanently affixed together, said single unit frames being affixed together thereby comprising a multiunit frame in the shape of a set of file cabinets placed side-by-side, said frame members defining frame holes, and each of said single unit frames and said multiunit frame defining a rectangular base, four sides, a top and an open interior, at least one of said single unit's frame's sides defining a door frame opening;

armor plates forming a top and at least three sides of said shelter having, interior and exterior sides and consisting of one bullet proof grade material chosen from the group ar400, ar450, ar500 and ar600 grade steel armor plates in thicknesses from ¼" to 1", other bullet-proof material, such as LEXAN® sheets in thicknesses from ¼" to 1", metal foam approximately 1" thick, bullet resistant fiberglass in thicknesses from ¼" to 1", bullet proof plastic sheets up to 1" thick, KEVLAR® sheets in thicknesses from ¼" to 1", GRAPHENE® in multiple thin layers, carbon nanotube material in thicknesses from ¼" to 1", and carbon fiber material up to 1∴ thick, said plates defining plate holes in the interior side of said plates extending partially or completely through the thickness of said plates, said plate holes being axially aligned with said frame holes on the exterior of said multiunit frame, and said top and said sides being removably affixed, external to said multiunit frame via one of threaded rods and bolts affixed to said plate holes at one of two ends and passing through and extending beyond said external multiunit frame holes at said second end, said one of threaded rods and bolts being secured, at said second end such that said side and said top plates of said multiunit shelter are removable only by a person or persons in the interior of said shelter, said choice of armor plate material and thicknesses thereof providing for customization of said multiunit shelter for desired level of protection from gunshot attack, weight and cost of said shelter, and ease of modifying said shelter;

a floor being affixed internal to said base of said multiunit frame;

at least four castors affixed to said base of said multiunit frame, said castors being essentially hidden from a potential attacker located outside said shelter by said armor plates; and said at least one door comprised of the same bullet proof plates as the sides and top, having interior and exterior sides and affixed by hinges to each said side of said multiunit frame which defines a door frame opening or openings, said hinges not being visible or accessible to a potential attacker when said door or doors are in a closed position, said door or doors each having a sliding door latch affixed to the interior side of said door by one or more brackets, said door latch or latches being operable to slidingly latch or unlatch each door only by a person or persons inside said shelter when each said door is in a closed position.

9. The safety shelter of claim 8 additionally comprising at least one hole defined by said floor open to the exterior of said shelter, said floor hole or holes providing for exchange of air into said shelter, for hidden Internet and phone access and for a source of power to a person or persons occupying said shelter.

10. The safety shelter of claim 8 further comprising a peephole defined by at least one said door, said peephole or peepholes each being covered by a shield comprised of one of said bullet proof armor plate materials and a grip affixed thereto, and said shield or shields being slidingly affixed to the interior side of each said door which defines a peephole by a bracket or brackets such that a person or persons inside said shelter can uncover said peephole by sliding the respective shield so as to see outside the shelter and can engage an attacker with a handgun or other weapon while being safe inside the shelter.

11. The multiunit safety shelter of claim 8 additionally comprising one or more decorative elements, such as false file drawer handles, file drawer labels, paint or false file drawer outlines, which thereby enhance the deceptive appearance of said multiunit safety shelter as being a set of file cabinets.

12. The multiunit safety shelter of claim 8 additionally comtprising a security ring affixed to the exterior of said multiunit shelter, said security ring being placed so as not to be visible to a potential attacker.

13. The multiunit safety shelter of claim 8 additionally comprising one or more sets of armor plates, each set consisting of one bullet proof grade material chosen from the group ar400, ar450, ar500 and ar600 grade steel armor plates in thicknesses from ¼" to 1", other bullet-proof material such as LEXAN® sheets in thicknesses from ¼" to 1", metal foam approximately 1" thick, bullet resistant fiberglass in thicknesses from ¼" to 1", bullet proof plastic sheets up to 1" thick, KEVLAR® sheets in thicknesses from ¼" to 1", GRAPHENE® in multiple thin layers, carbon nanotube material in thicknesses from ¼" to 1", and carbon fiber material up to 1" thick, said plates defining through holes axially aligned with said frame holes for mounting said plates such that said one of threaded rods and bolts pass through said plate holes sandwiched in between the external armor plates comprising the sides or top of said multiunit safety shelter and said multiunit frame.

14. A method of shielding a person or persons both from being detected and from being harmed by gunshot or other attack during a home or office invasion using a customized, modular, modifiable, bullet-proof, moveable, free-standing, indoor safety shelter in the shape of one file cabinet or a set of two or more file cabinets placed next to each other, said method comprising the steps of:

providing a frame comprised of one of steel and aluminum members affixed together in the shape of one or a set of two or more file cabinets, said frame defining a rectangular base, four sides, a top and an open interior, at least one of said sides defining a door frame opening;

defining frame boles in said frame members and removably attaching at least one bullet proof armor plate defining exterior and interior sides and consisting of one bullet proof grade material chosen from the group ar400, ar450, ar500 and ar600 grade steel armor plates in thicknesses from ¼" to 1", other bullet-proof material such as LEXAN® sheets in thicknesses from ¼" to 1", metal foam approximately 1" thick, bullet resistant fiberglass in thicknesses from ¼" to 1", bullet proof plastic sheets up to 1" thick, KEVLAR® sheets in thicknesses from ¼" to 1", GRAPHENE® in multiple thin layers, carbon nanotube material in thicknesses from ¼" to 1", and carbon fiber material up to 1" thick, the plate or plates defining plate holes in the interior side of said plates extending partially or completely through the thickness of said plates, said plate holes being axially aligned with said frame holes on the exterior of said frame;

affixing said armor plate or plates via one of threaded rods and bolts attached to said armor plates at one of two ends, said one of the rods and bolts passing through said frame holes into the interior of said frame and being affixed thereto by said second end such that only a person in the interior of said frame of said shelter can detach one or more of said armored plates when said plates comprise a side or sides or the top of said shelter such that a person or persons may escape from the shelter;

attaching at least one door via hinges to each said door frame opening, said door having interior and exterior sides and a latch mechanism only accessible to a person inside the shelter affixed to the interior side of each said door, and said door or doors each covering one said door frame opening when in a closed position; and attaching a floor to the base of said frame.

15. The method of claim 14 additionally comprising the step of affixing at least four castors to said base of said frame.

16. The method of claim 14 additionally comprising the step of defining a peephole through at least one said armor plate or door and covering said peephole by a shield having open and closed positions, said shield being comprised of said bullet proof armor with a grip attached, and slidingly affixing said shield to said interior side of each said armor plate or door defining a peephole.

17. The method of claim 14 additionally comprising the step of defining at least one floor hole in said floor.

18. The method of claim 14 further comprising the step of affixing a safety ring via a bracket attached to the exterior of the shelter.

19. The method of claim 14 further comprising the step of affixing one or more decorative features to the shelter thereby enhancing the deceptive appearance of the shelter as being one file cabinet, a set of two or more file cabinets, or other office or home furniture.

20. The method of claim 14 additionally comprising the step of customizing said safety shelter according to the requirements of a customer for protection level from ballistic weaponry, weight, size and cost by skilled selection among disclosed materials comprising said frame members and said armor plates and selection of appropriate optional features for initial installation or modification of the shelter.

* * * * *